US006230998B1

(12) United States Patent
Winkel

(10) Patent No.: US 6,230,998 B1
(45) Date of Patent: May 15, 2001

(54) METHOD FOR TRANSFERRING A WEB OF MATERIAL FROM A WOUND ROLL ONTO A WINDING TUBE, AND WINDING APPARATUS

(75) Inventor: Bernd Winkel, Kerken (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/244,017

(22) Filed: Feb. 4, 1999

(30) Foreign Application Priority Data

Feb. 5, 1998 (DE) ..... 198 04 411

(51) Int. Cl.[7] ..... B65H 18/06; B65H 19/26; B65H 19/28; B65H 19/29

(52) U.S. Cl. ..... 242/527.6; 242/527.7; 242/532.3; 242/580

(58) Field of Search ..... 242/527, 527.1, 242/527.2, 527.5, 527.6, 527.7, 532.3, 580; 83/508

(56) References Cited

U.S. PATENT DOCUMENTS

| | | | | |
|---|---|---|---|---|
| 1,876,075 | * | 9/1932 | Reichert et al. | 83/508 |
| 3,365,992 | * | 1/1968 | Dreher | 242/532.3 |
| 3,794,255 | | 2/1974 | Harmon et al. . | |
| 4,160,529 | * | 7/1979 | Hutzenlaub et al. | 242/527.5 |
| 4,304,368 | * | 12/1981 | Bartmann | 242/527.5 |
| 4,345,722 | | 8/1982 | Kuhn . | |
| 4,852,820 | * | 8/1989 | Looser | 242/527.2 |
| 5,092,533 | * | 3/1992 | Gangemi | 242/532.3 |
| 5,146,954 | * | 9/1992 | Ostyn et al. | 242/527.5 |
| 5,222,679 | | 6/1993 | Dropczynski et al. . | |
| 5,273,226 | * | 12/1993 | Dropczynski | 242/532.3 |
| 5,795,432 | * | 8/1998 | Urban | 242/527.6 |

FOREIGN PATENT DOCUMENTS

| | | |
|---|---|---|
| 2909736 | 9/1980 | (DE) . |
| 3008785 | 9/1981 | (DE) . |
| 4029180 | 3/1992 | (DE) . |
| 4115406 | 11/1992 | (DE) . |
| 0442038 | 8/1991 | (EP) . |
| 0553232 | 8/1993 | (EP) . |
| 92/05099 | 4/1992 | (WO) . |

OTHER PUBLICATIONS

Patent Abstracts of Japan, vol. 008, No. 026 (M–273) published Feb. 3, 1984 of JP 58 183553 published Oct. 26, 1983.

"Web Winding Apparatus," Research Disclosure, No. 160 XP002121291, p. 33 (Aug. 1997).

* cited by examiner

*Primary Examiner*—John M. Jillions
(74) *Attorney, Agent, or Firm*—Greenblum & Bernstein, P.L.C.

(57) ABSTRACT

Winding apparatus and method for transferring a web of material from a wound roll to a winding tube. The method includes applying an adhesive surface onto a severing region of the material web that surrounds a circumferential portion of a carrier roll, lifting the severing region of the web of material away from the carrier roll, and severing the web of material within the severing region. The winding apparatus includes two carrier rolls arranged to form a winding bed, a severing device, an adhesive applicator, and a retaining device including at least one roller segment that is switchable between two states.

25 Claims, 2 Drawing Sheets

METHOD FOR TRANSFERRING A WEB OF MATERIAL FROM A WOUND ROLL ONTO A WINDING TUBE, AND WINDING APPARATUS

CROSS-REFERENCE TO RELATED APPLICATIONS

The present application claims priority under 35 U.S.C. § 119 of German Patent Application No. 198 04 411.9, filed on Feb. 5, 1998, the disclosure of which is expressly incorporated by reference herein in its entirety.

BACKGROUND OF THE INVENTION

1. Field of the Invention

The present invention relates to a method for transferring a web of material from a wound roll onto a winding tube, in which a severing region of the web of material is provided with an adhesive surface and severed. The severing region is arranged to surround a circumferential portion of a carrier roll. The present invention also relates to a winding apparatus having two carrier rolls that form a winding bed, a severing device, an adhesive applicator, and a retaining device.

2. Discussion of Background Information

A method and winding apparatus of the type generally described above have been disclosed, e.g., in German Patent Disclosure DE 40 29 180 A1. These winding apparatuses serve to wind up a web of material, e.g., a paper web, into wound rolls that can be utilized by a user, e.g., a printing plant. As a rule, the length of the web of material is greater than what can be wound onto the wound roll. This happens, e.g., when the web of material is paid out from a larger jumbo or mother roll or when the web of material is produced in a continuous type of production process. In these type configurations, it is necessary, from time to time, to severe the web of material. The end of the web of material is then glued firmly to the fully wound roll, and the leading end of the web of material, i.e., the other side of the severing line, is to be fastened to a winding tube so that a new wound roll may be wound.

In known apparatuses for changing wound rolls, e.g., as disclosed in German Patent Disclosure DE 40 29 180 A1, the web of material is perforated before it contacts the carrier roll. As the web of material continues moving, e.g., into the region of the carrier roll, the web is provided with strips of adhesive that were previously stuck onto a transfer roller at low adhesion. When the web of material is to be severed, a somewhat greater tensile stress is sufficient to tear through the web of material along the perforated line.

A similar procedure is disclosed in European Patent Disclosure EP 0 553 232 B1. Again, the web of material is made sticky prior to contacting the carrier roll and is subsequently perforated in the middle of the adhesive surface.

Finally, as disclosed in European Patent Disclosure EP 0 442 038 B1, adhesive strips are laterally applied next to a perforation line. In this manner, both the perforation and the application of the adhesive strips can be performed by a single device.

In the above-noted devices, the severed edge is, as a rule, not clean. That is, between the perforation holes, the web of material is torn, which does not always result in the desired precision. Moreover, severing accomplished with the aid of a perforation can only be performed on webs up to only certain thicknesses.

In a support roll winder, in which the wound rolls, instead of resting on carrier rolls, are centrally held, e.g., as disclosed in German Patent Disclosure DE 41 15 406 A1, an adhesive strip dispenser is arranged on a traversing carriage, and a severing element in the form of a wheel is arranged to follow the dispenser. The wheel makes a cutting line in the center of the adhesive strip. However, this arrangement runs the risk that the support roller, on which the wound rolls rest, may also be damaged. Furthermore, it requires a relatively large amount of space.

SUMMARY OF THE INVENTION

The present invention provides a web winding device that includes improved results with regard to severing.

In a winding procedure as generally discussed above, the present invention provides for lifting the web of material away from the carrier roll in a severing region, and, while lifted away from the carrier roll, cutting the web all the way through.

In this way, a very clean severing line may be achieved, notwithstanding the thickness of the web of material. Even cardboard webs, e.g., can be severed in this way. A cut severing line is, as a rule, smoother and easier to manipulate than a torn severing line, even if the latter was the result of a perforation. Because the web of material is first lifted from the carrier roll in the severing region, the web of material can be cut without the fear that the carrier roll will be damaged in the process. Further, both sides of the web of material are accessible, so that there is relatively great freedom in creating the parting line.

Advantageously, a loop may be formed from the web of material in the severing region. Thus, the web of material may be lifted in the shape of an "Ω" from the surface of the carrier roll, which forms a "tunnel" to be entered by the cutting device. In any event, the cutting region of the cutting device can be kept away from the surface of the carrier roll.

It may be preferred to push the web of material together in the severing region. If the flat web of material is pushed together in the severing region, in either the same or the opposite direction from the travel direction during the winding, then the loop can be formed, or the lifting of the web of material from the web of material can be obtained, entirely automatically. As a rule, no other technical provisions, such as engaging the web of material from below, are necessary.

Preferably, the severing may be performed when the wound roll is resting on two carrier rolls. That is, the severing is done while the winding bed is still closed. This may be advantageous in that the end of the web of material on the wound roll may be firmly held, specifically by the force of gravity that is operative in the nip between the wound roll and the carrier roll. Further, relatively clearly defined tension ratios, which contribute to the quality of the cut, may then obtained.

Preferably, the severing is performed in a quadrant of the carrier roll that is located above a horizontal plane through the axis of the carrier roll. Thus, the leading edge of the web of material, which afterward is to be applied to the winding tube, is already located above the plane, and is accordingly at least slightly supported from below by the carrier roll. This arrangement also makes it easier to pull the leading edge of the web of material forward after the severing has been performed.

Advantageously, the severing may be performed below a line along which the winding tube touches the carrier roll. When the winding tube is placed in the winding bed, it may still be necessary in some cases to align it with the web of material. This is especially true if the winding apparatus is to be utilized on a roll cutter that cuts a plurality of split or partial webs from one web of material. If so, the winding tubes must be brought into the proper position relative to the position of the split webs. These and other manipulations are still possible with the present invention, as long as the winding tubes (or cores) have not yet entered into an adhesive connection with the leading end of the web of material.

Preferably, the web of material may be firmly held below the cutting line before, during and after severing. The term "below" is not necessarily gravity-oriented but is meant instead to designate the leading end of the web of material that is then joined to the winding tube. In this embodiment, care is taken on both sides of the cutting line to have the web of material at a defined position, so that the cut can be made with the desired quality.

The severing is preferably performed in scissor-cut fashion, which is a high-quality cut that results in a smooth, clean severing line.

The adhesive surface may be advantageously created at a location where the web of material rests on the carrier roll. An abutment may then be available when the adhesive surface is made, so that a double-sided adhesive tape, for instance, can be readily pressed on.

In a winding apparatus of the type defined above, the apparatus includes a retaining device having at least one roller segment, which can be switched between two states.

For instance, the roller segment can run freely in one state and be braked in the other state. If the roller segment is braked and the carrier roll is rotated backward, then the web of material may be fed backward again somewhat from the wound roll, but the web of material cannot escape from or slide past the retaining device. Thus, the web of material is pushed together and lifted from the carrier roll. If the roller segment is switched over to a free-wheeling state, then the web of material can follow the carrier roll as it rotates. In this way, the leading end of the web of material can be pushed farther forward, so that it comes into contact with a new winding tube, for instance. Other states are also conceivable. For instance, the roller segment can be either drivable or free-wheeling. If it is driven, then it can push the web of material, even when the carrier roll is stopped, in the direction of the nip between the carrier roll and the wound roll. In this manner, the web of material in the region between the retaining device and the nip may be lifted from the carrier roll. The roller segment can also be stopped again, to prevent the web of material from moving while it is being cut through. Finally, the carrier roll and the roller segment can also be actuated simultaneously, in order to push the web of material together. With all these options, lifting of the web of material from the surface of the carrier roll can be provided relatively simply, without having to reach under the web of material.

The retaining device advantageously exerts a contact pressure that is variable on the web of material. For instance, the contact pressure can be lowered when the web of material is to be pushed together by rotating the carrier roll in reverse. In this case, the retaining device may prevent the web of material from being pushed backward. However, the friction between the web of material and the carrier roll is so slight that no damage occurs.

The retaining device advantageously has an upward-pointing portion whose surface can be readily separated from the adhesive surface, i.e., this surface has relatively low adhesion. This surface can then be placed in the sticky severing region and can firmly hold the web of material, or more precisely its leading end, there, yet without creating problems later on when the web of material is to be peeled off again. Especially whenever the wound roll is wound in a winding bed formed by two carrier rolls, this prevents the leading end of the web of material from sticking firmly to the second carrier roll.

It is preferred that the upward-pointing portion be formed as a tined rake so that the leading end of the web of material may be held only by individual tines. The engagement points of the tines can even be limited to the tips or smaller areas of the surface. The tines need not exert excessive force on the web of material. They are intended merely to prevent the leading end of the web of material from tipping onto the second carrier roll.

Advantageously, the severing device may include a traversing cutting device. As a rule, this kind of cutting device is less expensive than a knife that extends over the full width of the winding device. Furthermore, beyond a certain width of the web of material, it is practically impossible to make a precise cut using a continuous knife or other cutting device. This embodiment has the further advantage that it can be retrofitted into existing winding devices. A traversing cutting device can often still be accommodated even when space is tight.

Advantageously, the cutting device may include a transporting foot that can be mounted on the carrier roll. This transporting foot can be formed either as a slidable carriage or as a rollable roller. With the aid of the transporting foot, the cutting device can be supported to assume a defined position relative to the web of material, which may be advantageous in making a precise cut.

The transporting foot, on its top, advantageously has a cutting edge that cooperates with a rotating cutting knife. The rotating cutting knife then cooperates continuously in scissors-like fashion with the cutting edge, so that a continuous scissor cut can be made.

In this respect it is especially preferred that the cutting knife has the shape of a regular polygon.

Accordingly, the present invention is directed to a method for transferring a web of material from a wound roll to a winding tube that includes applying an adhesive surface onto a severing region of the material web that surrounds a circumferential portion of a carrier roll, lifting the severing region of the web of material away from the carrier roll, and severing the web of material within the severing region.

According to another feature of the present invention, the lifting away includes forming a loop in the severing region of the web of material.

According to another feature of the present invention, the lifting away includes pushing the severing region of the web of material together.

According to still another feature of the present invention, the severing is performed when the wound roll is resting on two carrier rolls.

According to a further feature of the present invention, the severing is performed in a quadrant of the carrier roll that is located above a horizontal plane that extends through a rotational axis of the carrier roll.

According to a further feature of the present invention, the severing is performed below a line along which the winding tube contacts the carrier roll.

According to a still further feature of the present invention, the method further includes firmly holding the web of material below a cutting line before, during, and after the severing.

According to another feature of the present invention, the severing includes cutting in a scissor-cut fashion.

According to still another feature of the present invention, the adhesive surface is applied at a location where the web of material rests on the carrier roll.

The present invention is also directed to a winding apparatus that includes two carrier rolls arranged to form a winding bed, a severing device, an adhesive applicator, and a retaining device including at least one roller segment that is switchable between two states.

According to another feature of the present invention, the retaining device is adapted to exert a variable contact pressure on the web of material.

According to another feature of the present invention, the retaining device further includes an upward-pointing portion having a surface that is readily separable from the adhesive surface. Further, the upward-pointing portion includes a tined rake.

According to still another feature of the present invention, the severing device includes a traversing cutting device. Further, the cutting device includes a transporting foot that is mountable on the carrier roll. Still further, the cutting device includes a rotating cutting knife, and the transporting foot has a cutting edge on its top that cooperates with the rotating cutting knife. The cutting knife may be shaped as a regular polygon.

The present invention is also directed to a winding apparatus that includes two carrier rolls arranged to form a winding bed, a severing device, an adhesive applicator, and a retaining device positionable against one of the two carrier rolls.

According to another feature of the present invention, the retaining device includes at least one roller segment having a roller surface adapted so that a frictional force between the roller surface and the web of material is greater than a frictional force between the web of material and a peripheral surface of the one carrier roll. In particular, the at least one roller segment may be switchable between a free-wheeling state and a braked state, or the at least one roller segment may be switchable between a free wheeling state and a driven state.

According to still another feature of the present invention, the severing device includes a scissor device.

The present invention is also directed to a method of operating a winding apparatus to transfer a web of material from a wound roll to a winding tube. The winding apparatus may include two carrier rolls arranged to form a winding bed, a severing device, an adhesive applicator, and a retaining device positionable against one of the two carrier rolls. The method includes rotating the wound roll, guiding the web of material around one of the two carrier rolls to the wound roll, applying adhesive from the adhesive applicator to the web of material to form an adhesive surface, lifting the adhesive surface away from a peripheral surface of the one carrier rolls, and cutting the lifted away adhesive surface of the web of material.

According to another feature of the present invention, the lifting includes holding the web of material against the one carrier roll with the retaining device, and reversing a winding direction of the wound roll. In this manner, a loop of the web of material is formed in the winding bed.

According to still another feature of the present invention, the lifting includes stopping the rotation of the wound roll, and driving the retaining device to guide the web of material into the winding bed. In this manner, a loop of the web of material is formed in the winding bed.

According to a further feature of the present invention, the retaining device includes a tined rake, and the method further includes positioning tines of the tined rake against the web of material. In this manner, the tines hold the web of material in place during the lifting off.

According to yet another feature of the present invention, the method further includes adhering a trailing edge of the cut web of material to the wound roll, and guiding a leading edge of the cut web of material to a winding tube arranged in the winding bed.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
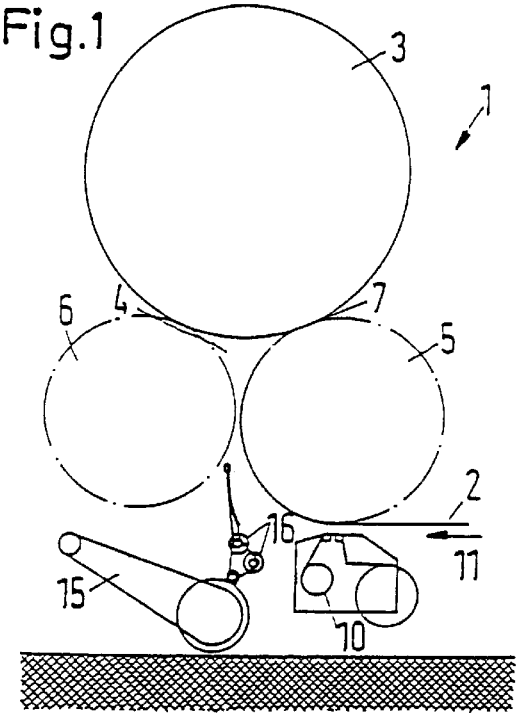
FIG. 1 illustrates a winding apparatus according to the present invention during a winding procedure.

Winding apparatus 1, as illustrated in FIG. 1, may be utilized to wind up a web of material 2 into a wound roll 3. Wound roll 3 may be arranged to rest in a winding bed 4, which is formed by a first carrier roll 5 and a second carrier roll 6. To clearly indicate the course of web of material 2, carrier rolls 5 and 6 have been represented by dot-dashed lines. Web of material 2 is passed between carrier rolls 5 and 6 along the peripheral surface of first carrier roll 5 to a nip 7, formed between first carrier roll 5 and wound roll 3. After nip 7, web 2 is transferred to wound roll 3. Wound roll 3 may be rotatably driven via rotation of one or both carrier rolls 5 and 6, in a known manner.

Once wound roll 3 has reached its rated or desired diameter, the winding operation is discontinued so that the roll can be changed. Accordingly, web 2 must be transferred from full wound roll 3 onto a new winding tube 8 (see FIG. 4). This action requires severing web 2 and fastening the end of web 2 onto wound roll 3, and guiding a leading end of web 2 to be fastened to winding tube 8.

Figure 2:
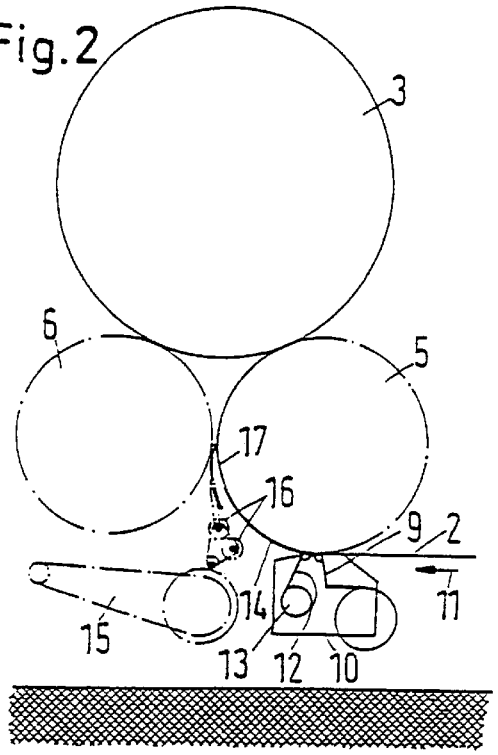
FIG. 2 illustrates the winding apparatus during the application of an adhesive tape.

The fastening may be achieved via double-sided adhesive tape 9, which can be applied to web 2 with an adhesive applicator. As illustrated in FIG. 2, adhesive applicator 10 may be raised upwardly so that the adhesive tape rests on web 2. Adhesive tape 9 may be applied, e.g., in the form of a plurality of strips distributed both in the longitudinal (or web travel) direction 11 and crosswise to web travel direction 11. Adhesive tape 9 may be provided with low adhesion on a backing tape 12, which is wound up onto a spool 13 once the tape has been applied.

The region where adhesive tape 9 has been applied to the web of material may be referred to as the adhesive surface 14, which, for the sake of clarity, has been depicted with a somewhat thicker line. Of course, in practice, adhesive tape 9 is not applied so thickly. Adhesive surface 14 also forms a severing region, because, as will be explained below, it is within this region that the severing cut is to be made.

The application of adhesive tape 9 is performed at reduced web speed. Once adhesive surface 14 has been made, wound roll 3 may be rotated onward until adhesive surface 14 is located just upstream of nip 7. At this point, adhesive surface 14 is located essentially on the upper, inner quadrant of carrier roll 5.

At the same time adhesive surface 14 is being moved forward, a web retaining device 15 may be driven from below into the space between carrier rolls 5 and 6. Web retaining device 15 includes two roller segments 16, i.e., rollers that can be braked. If roller segments 16 are not braked, then they are formed as free-wheeling rollers. Roller segments 16 have a surface that is adapted to web 2 so that web 2 slides substantially less well on roller segments 16 than on carrier roll 5.

Web retaining device 15 also includes a tined rake 17, i.e., an arrangement of tines 18 (see FIG. 6) arranged side by side, which are provided with a low-friction surface on their side arranged toward carrier roll 5. The low friction surface is formed so that adhesive tape 9 does not adhere as well to tines 18 as it does to web 2.

Once adhesive surface 14 has been advanced far enough, web retaining device 15 moves into its final position, i.e., the roller segments 16 are pressed against web 2 outside of adhesive surface 14. Tined rake 17 acts on web 2 within adhesive region 14.

Figure 3:
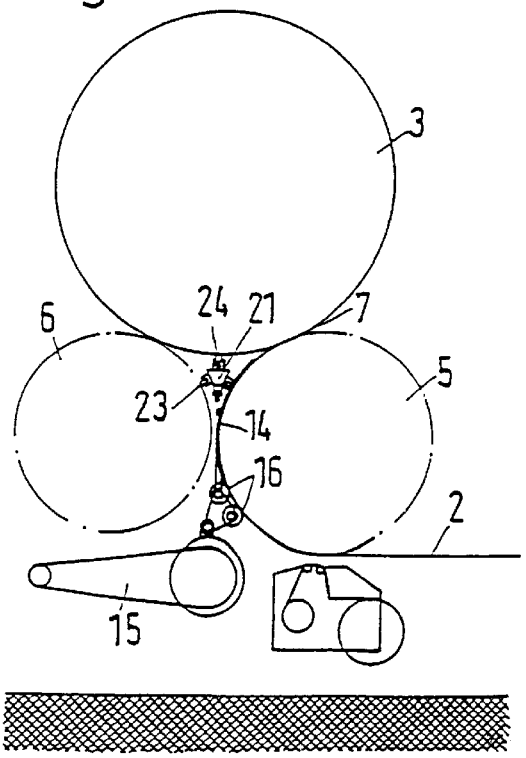
FIG. 3 illustrates the winding apparatus during the cutting of a web of material.
Figure 5:
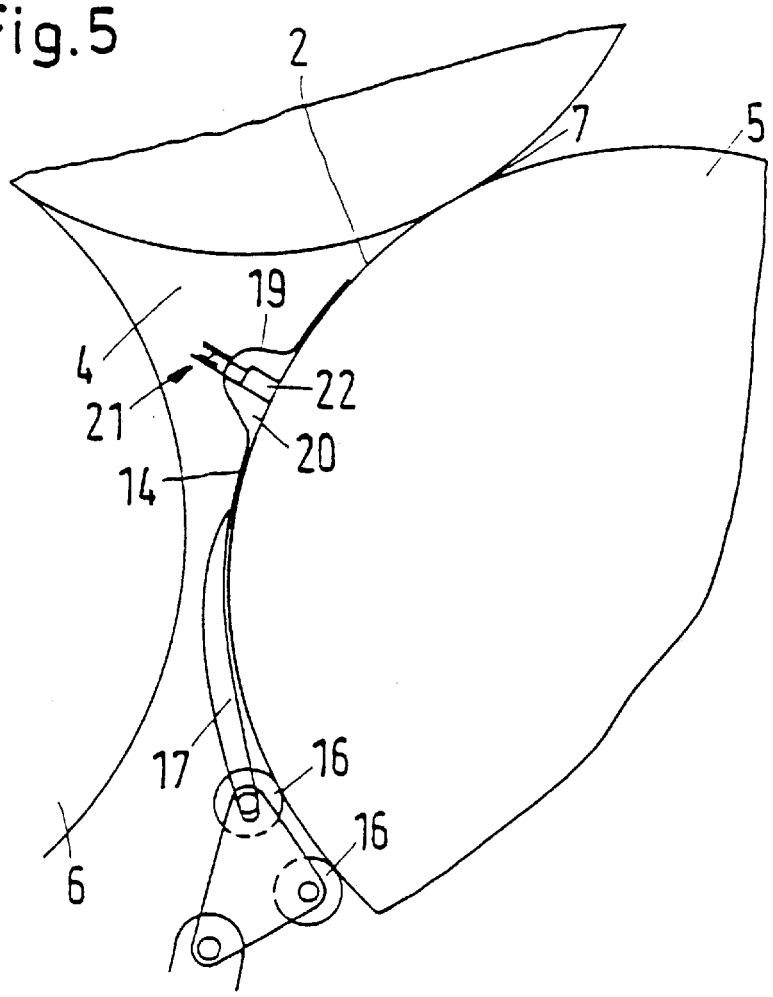
FIG. 5 illustrates an enlarged side view of the winding apparatus of the present invention.

Roller segments 16 are now arrested, and carrier roll 5 may be rotated backward somewhat. In this process, web 2 is pushed back from wound roll 3 into winding bed 4. Because roller segments 16 are braked, web 3 cannot be guided farther around carrier roll 5. Thus, web 2 is pushed into winding bed 4, whereby a loop 19 is formed. In forming loop 19, web 2 is thereby lifted from the surface of carrier roll 5 in the region of adhesive surface 14. Into the thus-formed hollow space of loop 19, a cutting device 21, which can be supported by a transporting foot 22 (see FIG. 5) on carrier roll 5 can be driven. Other rollers 23 and 25 have been depicted in FIG. 3 but are not shown in FIG. 5 for the sake of simplicity.

With the aid of these rollers, cutting device 21 can be provided with a very stable position within winding bed 4, so that when it is moved over the width of carrier roll 5, cutting device 21 produces a very accurately predictable cutting line. Drive mechanisms, which are known per se have not been depicted here, can be utilized to drive cutting device 21. Such known drive mechanisms include, e.g., a telescoping cylinder, a rodless cylinder, or a rail along which cutting device 21 can be moved with the aid of an electric drive mechanism or a cable pull. Accordingly, drive mechanism 27 has only been schematically depicted.

Figure 6:
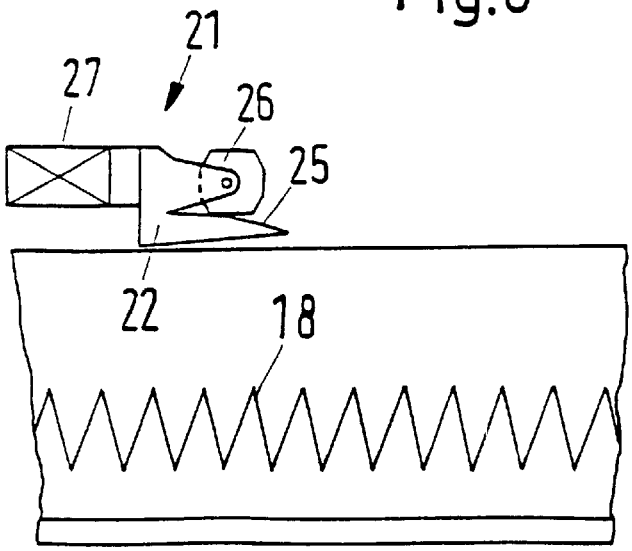
FIG. 6 illustrates a front view of a carrier roll.

As illustrated in FIG. 6, cutting device 21 may include, e.g, a cutting edge 25 positioned above a transporting foot 22. Cutting wheel 26 or cutting knife of, e.g., octagonal shape, comes to rest against cutting edge 25. Cutting wheel 26 may be continuously rotated so that web 2 may be cut apart by a scissors device in continuous operation.

As soon as web 2 has been cut through over its entire width, wound roll 3 may again be rotated onwardly. Moreover, adhesive surface 14 has now been divided into two halves 14*a* and 14*b* by cutting device 21. First half 14*a*, which forms a trailing edge of web 2 in wound roll 3, may be utilized to glue the trailing edge to wound roll 3, thereby completing the winding process. As wound roll 3 rotates onward, adhesive surface 14*a* passes through nip 7, whereby the pressure within nip 7 adheres first adhesive surface 14*a* of the trailing edge to wound roll 3.

With its tined rake 17, web retaining device 15 prevents adhesive surface 14*b* from coming into contact with carrier roll 6 and from sticking to carrier roll 6.

Figure 4:
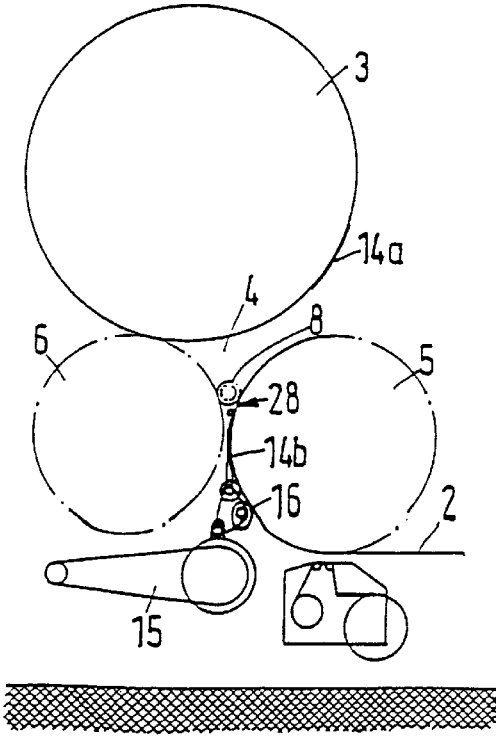
FIG. 4 illustrates the expelling of a wound roll from the winding apparatus.

As illustrated in FIG. 4, cutting line 28 may be located so that new winding tube 8, once it has been placed onto winding bed 4, does not come into contact with second adhesive surface 14*b*. In this manner, it would still be possible to position winding tube 8 within winding bed 4, if necessary. In the exemplary embodiment, winding apparatus 1 may be provided for use downstream of a roll cutter, or, in other words, is provided to wind up a plurality of split or partial webs, and it is also true that a plurality of winding tubes 8 should be placed, in an axial alignment with one another, in winding bed 4. This can be performed by inserting winding tubes 8 by one face end. A rodless cylinder is conceivable for this purpose. Alternatively, winding tubes 8 can also be inserted in several stages, or a belt elevator can be used, which has one or more dividers, and that can put winding tubes 8 that are held in readiness on an inclined plane into place in succession.

When the state shown in FIG. 4 is attained, and the blocking of roller segments 16 has been removed, carrier roll 5 may be rotated further. The contact pressure of roller segments 16 against web 2 can optionally be increased still further. As a result, web 2 may be advanced up to winding tube 8 and may come into contact with winding tube 8. With the aid of the adhesive surface 14, the gluing of the leading end to winding tube 8 is completed. Once that state is reached, web retaining device 15 can again be lowered so that the state shown in FIG. 1 is again attained.

In a manner not shown in detail, but known per se, the winding tube 8, at the onset of the winding operation, can also be acted upon by pressure, e.g., a contact pressure device, so as to vary the winding hardness.

Loop 19 can also be made in some other way, e.g., roller segments 16 can be formed in drivable fashion. If carrier roll 5 is at a stop and roller segments 16 are driven so that web 2 is fed farther into winding bed 4, then precisely the same effect is attained. It is also conceivable to push web 2 together from both sides.

Finally, carrier roll 5 can also be formed as a suction roller, and carrier roll 6 can be made drivable. In this case, web retaining device 15 can be omitted. If carrier roll 6 is rotated backward somewhat, then lifting of web 2 from carrier roll 5 can be obtained. For reinforcement purposes, the region where cutting device 21 is operative can also be kept out of suction range of carrier roll 5. For instance, a stationary covering for suction openings in the interior of carrier roll 5 may be provided here.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A method for transferring a web of material from a wound roll to a winding tube comprising:

applying an adhesive surface onto a severing region of the material web that surrounds a circumferential portion of a carrier roll, such that the adhesive surface is applied at a location where the web of material rests on the carrier roll;

lifting the severing region of the web of material away from the carrier roll; and severing the web of material within the severing region and through the adhesive surface, whereby the adhesive surface is divided into two parts.

2. The method of claim 1, the lifting away comprising forming a loop in the severing region of the web of material.

3. The method of claim 1, wherein the severing is performed in a quadrant of the carrier roll that is located above a horizontal plane that extends through a rotational axis of the carrier roll.

4. The method of claim 1, wherein the severing is performed below a line along which the winding tube contacts the carrier roll.

5. The method of claim 1, further comprising firmly holding the web of material below a cutting line before, during, and after the severing.

6. The method of claim 1, wherein the severing comprises cutting in a scissor-cut fashion.

7. A method for transferring a web of material from a wound roll to a winding tube comprising:

applying an adhesive surface onto a severing region of the material web that surrounds a circumferential portion of a carrier roll;

lifting the severing region of the web of material away from the carrier roll; and severing the web of material within the severing region, wherein the lifting away comprises pushing portions of the severing region of the web of material together.

8. A method for transferring a web of material from a wound roll to a winding tube comprising:

applying an adhesive surface onto a severing region of the material web that surrounds a circumferential portion of a carrier roll;

lifting the severing region of the web of material away from the carrier roll; and severing the web of material within the severing region, wherein the severing is performed when the wound roll is resting on two carrier rolls.

9. A winding apparatus comprising:

two carrier rolls arranged to form a winding bed;

a severing device;

an adhesive applicator arranged to apply adhesive to a portion of a web while it is supported on one of the two carrier rolls; and a retaining device including at least one roller segment that is switchable between two states, wherein the severing device is arranged to sever the adhesive portion of the web to form two separate parts.

10. The apparatus of claim 9, the retaining device further including an upward-pointing portion having a surface that is readily separable from an adhesive surface.

11. A winding apparatus comprising:

two carrier rolls arranged to form a winding bed;

a severing device;

an adhesive applicator; and a retaining device including at least one roller segment that is switchable between two states, wherein the retaining device is adapted to exert a variable contact pressure on a web of material.

12. A winding apparatus comprising:

two carrier rolls arranged to form a winding bed:

a severing device;

an adhesive applicator; and a retaining device including at least one roller segment that is switchable between two states, wherein the retaining device further includes an upward-pointing portion having a surface that is readily separable from an adhesive surface, and wherein the upward-pointing portion comprises a tined rake.

13. A winding apparatus comprising:

two carrier rolls arranged to form a winding bed;

a severing device comprising a traversing cutting device including a regular polygon shaped cutting knife;

an adhesive applicator arranged to apply adhesive to a portion of a web while it is supported on one of the two carrier rolls; and a retaining device including at least one roller segment that is switchable between two states; and the cutting device further including a transporting foot that is mountable on the one carrier roll.

14. The apparatus of claim 13, wherein the regular polygon shaped cutting knife is a rotating cutting knife; and the transporting foot has a cutting edge on its top that cooperates with a rotating cutting knife.

15. A winding apparatus comprising:

two carrier rolls arranged to form a winding bed;

a severing device;

an adhesive applicator which is positionable against one of the two carrier rolls to apply an adhesive surface onto a portion of the web which is supported by the one carrier roll; and a retaining device positionable against one of the two carrier rolls, wherein the severing device is arranged to sever the adhesive surface to form two separate adhesive parts.

16. The winding apparatus of claim 15, the severing device comprising a scissor device.

17. A winding apparatus comprising:

two carrier rolls arranged to form a winding bed;

severing device;

an adhesive applicator;

a retaining device positionable against one of the two carrier rolls; and the retaining device comprising at least one roller segment having a roller surface adapted so that a frictional force between the roller surface and the web of material is greater than a frictional force between the web of material and a peripheral surface of the one carrier roll.

18. The winding apparatus of claim 17, the at least one roller segment being switchable between a free wheeling state and a braked state.

19. The winding apparatus of claim 17, the at least one roller segment being switchable between a free wheeling state and a driven state.

20. A method of operating a winding apparatus to transfer a web of material from a wound roll to a winding tube, the winding apparatus including two carrier rolls arranged to form a winding bed, a severing device, an adhesive applicator, and a retaining device positionable against one of the two carrier rolls, the method comprising:

rotating the wound roll;

guiding the web of material around one of the two carrier rolls to the wound roll;

applying adhesive from the adhesive applicator to the web of material to form an adhesive surface;

lifting the adhesive surface away from a peripheral surface of the one carrier rolls while the wound roll remains on said carrier rolls; and cutting the lifted away adhesive surface of the web of material.

21. The method of claim 20, further comprising:

adhering a trailing edge of the cut web of material to the wound roll; and guiding a leading edge of the cut web of material to a winding tube arranged in the winding bed.

22. A method of operating a winding apparatus to transfer a web of material from a wound roll to a winding tube, the winding apparatus including two carrier rolls arranged to form a winding bed, a severing device, an adhesive applicator, and a retaining device positionable against one of the two carrier rolls, the method comprising:

rotating the wound roll;

guiding the web of material around one of the two carrier rolls to the wound roll;

applying adhesive from the adhesive applicator to the web of material to form an adhesive surface;

lifting the adhesive surface away from a peripheral surface of the one carrier rolls; and cutting the lifted away adhesive surface of the web of material, wherein the lifting comprises holding the web of material against the one carrier roll with the retaining device; and reversing a winding direction of the wound roll, whereby a loop of the web of material is formed in the winding bed.

23. A method of operating a winding apparatus to transfer a web of material from a wound roll to a winding tube, the winding apparatus including two carrier rolls arranged to form a winding bed, a severing device, an adhesive applicator, and a retaining device positionable against one of the two carrier rolls, the method comprising:

rotating the wound roll;

guiding the web of material around one of the two carrier rolls to the wound roll;

applying adhesive from the adhesive applicator to the web of material to form an adhesive surface;

lifting the adhesive surface away from a peripheral surface of the one carrier rolls; and cutting the lifted away adhesive surface of the web of material, wherein the lifting comprises stopping the rotation of the wound roll; and driving the retaining device to guide the web of material into the winding bed, whereby a loop of the web of material is formed in the winding bed.

24. A method of operating a winding apparatus to transfer a web of material from a wound roll to a winding tube, the winding apparatus including two carrier rolls arranged to form a winding bed, a severing device, an adhesive applicator, and a retaining device positionable against one of the two carrier rolls, the method comprising:

rotating the wound roll;

guiding the web of material around one of the two carrier rolls to the wound roll;

applying adhesive from the adhesive applicator to the web of material to form an adhesive surface;

lifting the adhesive surface away from a peripheral surface of the one carrier rolls; and cutting the lifted away adhesive surface of the web of material, wherein the retaining device includes a tined rake, and the method further includes: positioning tines of the tined rake against the web of material, whereby the tines hold the web of material in place during the lifting off.

25. A winding apparatus comprising:

two carrier rolls arranged to form a winding bed;

a severing device comprising a traversing cutting device including a regular polygon shaped cutting knife;

an adhesive applicator arranged to apply adhesive to a portion of a web while it is supported on one of the two carrier rolls; and a retaining device including at least one roller segment that is switchable between two states, wherein the traversing cutting device is arranged to divide the adhesive portion of the web.

* * * * *